US009863177B2

(12) United States Patent
Zimmer et al.

(10) Patent No.: US 9,863,177 B2
(45) Date of Patent: Jan. 9, 2018

(54) SLIDING DOOR TOP GUIDE FITTING

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 15/072,042

(22) Filed: Mar. 16, 2016

(65) Prior Publication Data

US 2016/0281406 A1 Sep. 29, 2016

(30) Foreign Application Priority Data

Mar. 17, 2015 (DE) ..... 10 2015 003 423

(51) Int. Cl.

| | |
|---|---|
| ***E05F 11/00*** | (2006.01) |
| ***E05D 15/06*** | (2006.01) |
| ***E05F 5/00*** | (2017.01) |
| ***E06B 3/46*** | (2006.01) |

(52) U.S. Cl.

CPC ..... *E05D 15/0652* (2013.01); *E05D 15/063* (2013.01); *E05F 5/003* (2013.01); *E06B 3/4636* (2013.01); *E05Y 2201/64* (2013.01); *E05Y 2600/46* (2013.01); *E05Y 2600/53* (2013.01); *E05Y 2900/132* (2013.01)

(58) Field of Classification Search

CPC . E05D 15/0652; E05D 15/063; E06B 3/4636; E05F 5/003

See application file for complete search history.

(56) References Cited

U.S. PATENT DOCUMENTS

| | | | | | |
|---|---|---|---|---|---|
| 3,771,823 | A * | 11/1973 | Schnarr | E05C 17/28 | 16/48.5 |
| 5,072,973 | A * | 12/1991 | Gudgel | E05C 17/28 | 292/201 |
| 5,901,992 | A * | 5/1999 | Winkler | E05C 17/28 | 292/201 |
| 2007/0186481 | A1* | 8/2007 | Tomita | E05F 1/16 | 49/409 |
| 2010/0293859 | A1* | 11/2010 | Nezu | E05B 65/0858 | 49/358 |
| 2011/0271482 | A1* | 11/2011 | Nezu | E05F 1/16 | 16/49 |
| 2016/0281406 | A1* | 9/2016 | Zimmer | E06B 3/4636 | |

FOREIGN PATENT DOCUMENTS

| | | | | |
|---|---|---|---|---|
| CN | 000202 418 140 U | | 2/2012 | |
| DE | 102015003427 B3 | * | 7/2016 | E05F 5/003 |
| EP | 0 239 823 A2 | | 4/1987 | |
| EP | 2 476 841 A1 | | 7/2012 | |
| EP | 3070244 A1 | * | 9/2016 | E05D 15/063 |
| WO | WO 2014169771 A1 | * | 10/2014 | E05F 5/003 |

* cited by examiner

*Primary Examiner* — Jerry E Redman
(74) *Attorney, Agent, or Firm* — Klaus J. Bach

(57) ABSTRACT

In a door fitting for the upper guidance of sliding doors, which door fitting comprises a base body and at least one support element which is releasably connected to the base body, the base body and the support element are interconnected by means of two spaced joint areas. The first joint area comprises a snap-in connection with a certain pivoting capability. The second joint area includes a push joint with an axial degree of freedom which is oriented tangentially with respect to an imaginary co-axial cylinder extending around the pivot axis of the first joint area and parallel to the installation direction of the snap-in connection.

9 Claims, 3 Drawing Sheets

SLIDING DOOR TOP GUIDE FITTING

BACKGROUND OF THE INVENTION

The invention concerns a door fitting for the upper guidance of sliding doors which fitting includes a base body and at least one support element releasably arranged on the base body and also a sliding door with such a door fitting.

CN 202 418 140 U discloses this type of door fittings. The support element in this publication is supported on a profile rod within the door frame and, after installation of the base body is hooked into it.

It is the object of the present invention to provide a door fitting which can be easily installed and safely remains in its place.

SUMMARY OF THE INVENTION

In accordance with the present invention the base body and the support element are interconnected at two spaced support locations. The first support location comprises a snap-in connection with a certain degree of pivotal movement freedom. The second support location comprises a push joint with an axial degree of freedom, which extends tangentially to an imaginary coaxial cylinder around the pivot axis of the first support location and parallel to the mounting direction or snap-in connection.

The invention will become more readily apparent from the following description with reference to schematically shown embodiments shown in the drawings.

DESCRIPTION OF EXEMPLARY EMBODIMENTS

Figure 1:
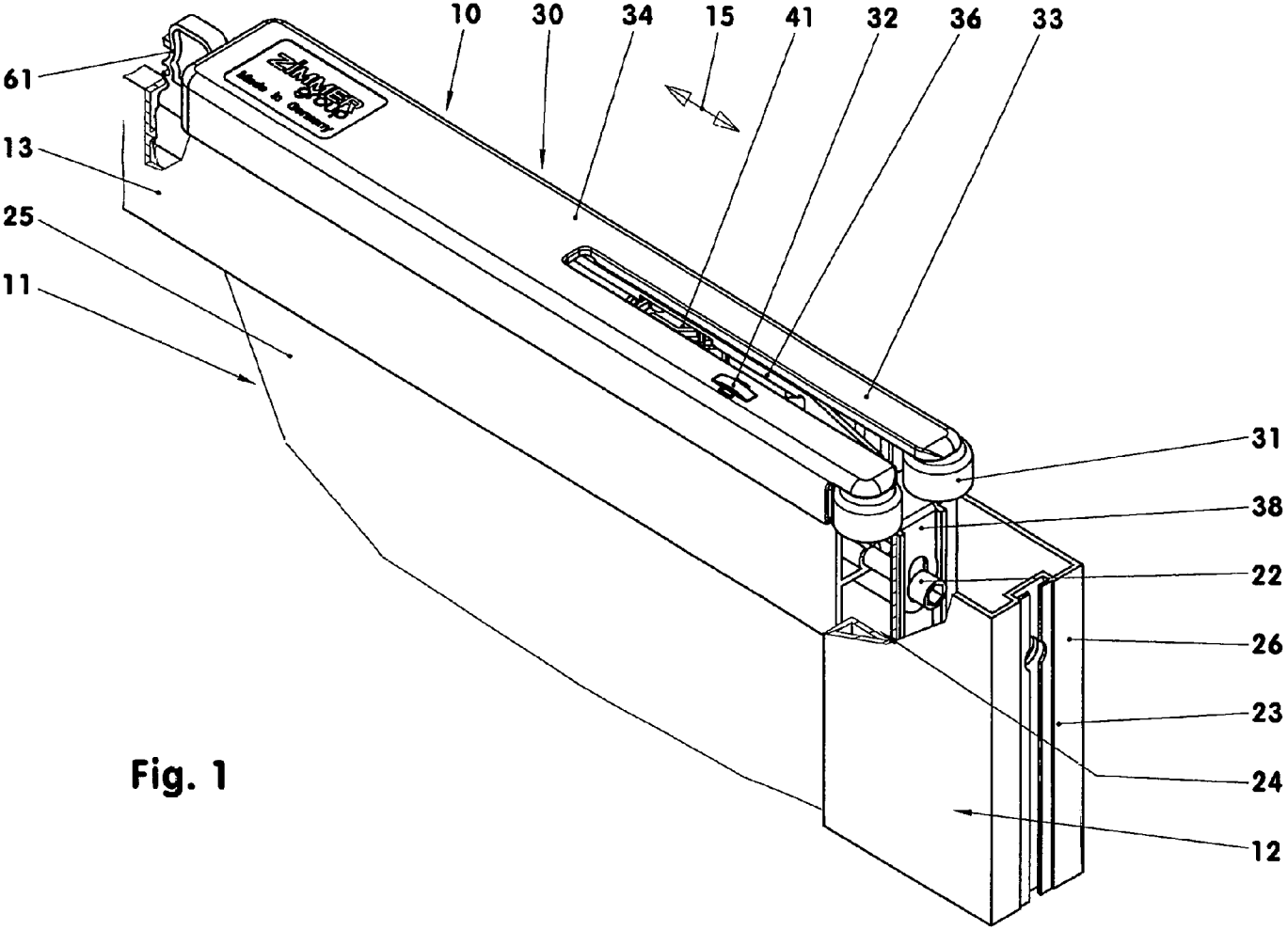
FIG. 1: an isometric view of an upper guide structure of sliding door.
Figure 2:
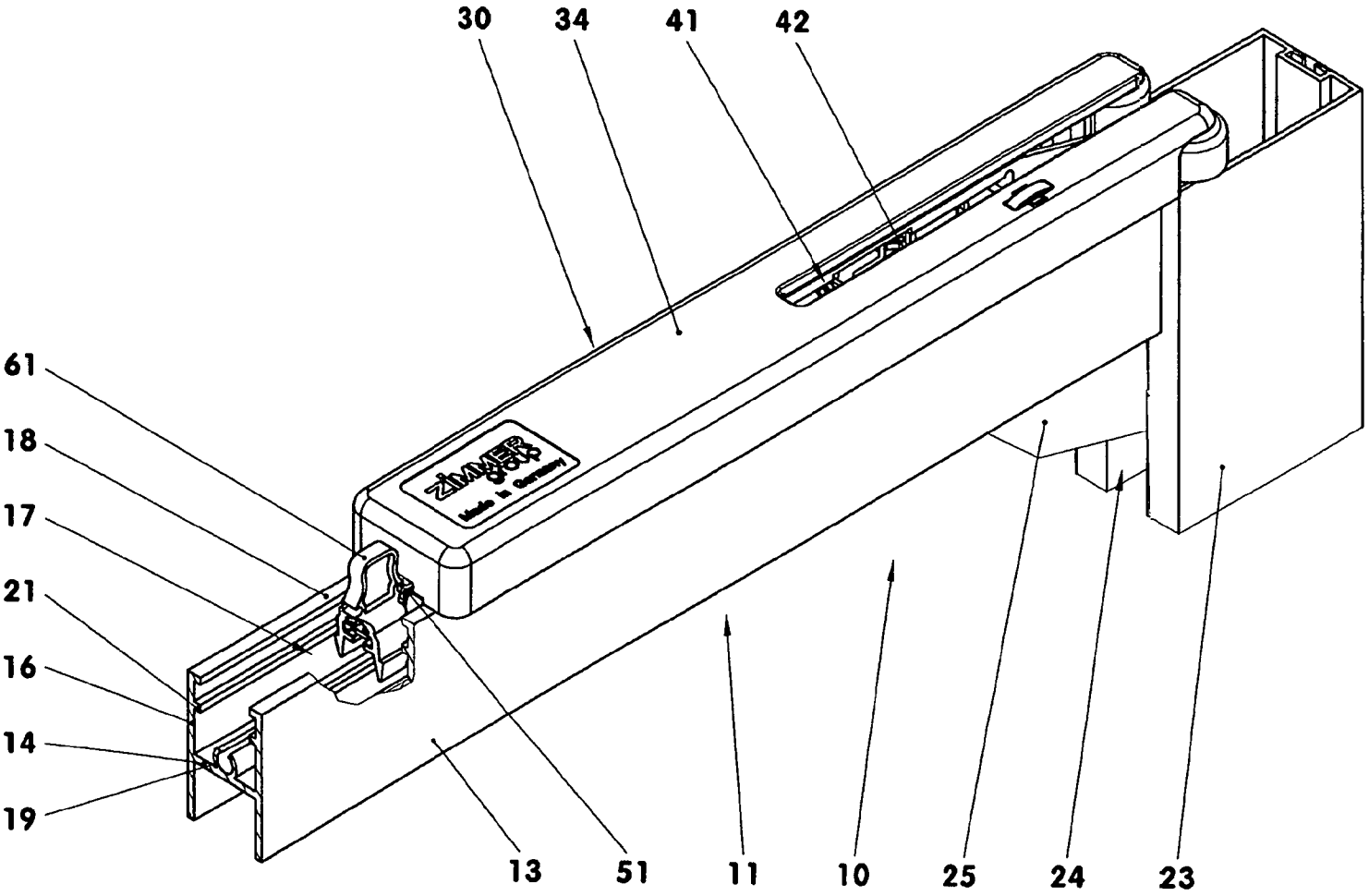
FIG. 2: a rear view of FIG. 1.
Figure 3:
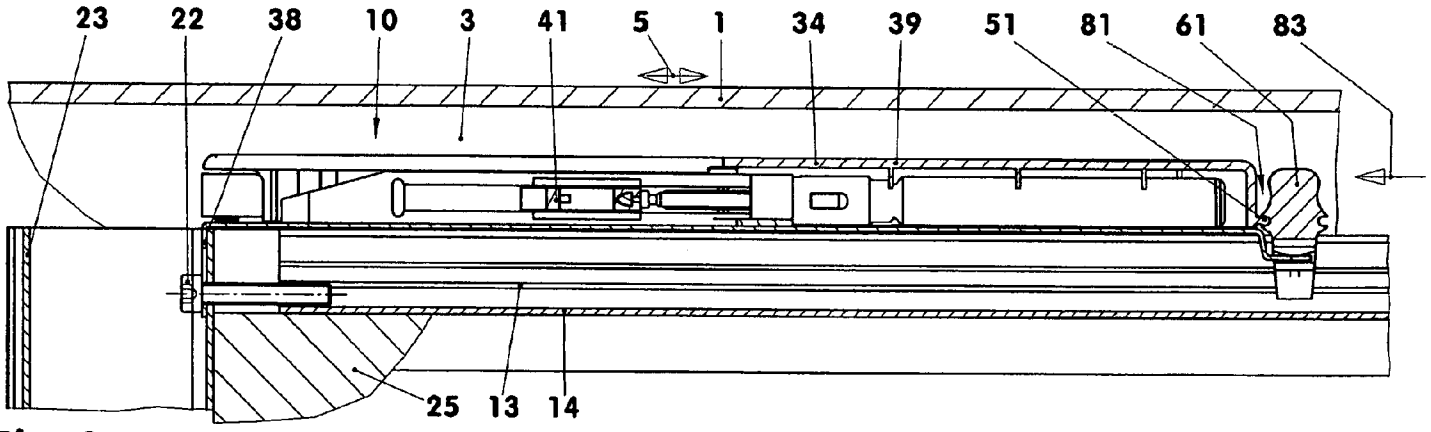
FIG. 3: a longitudinal cross-sectional view of the upper guide structure with a door guide track.
Figure 4:
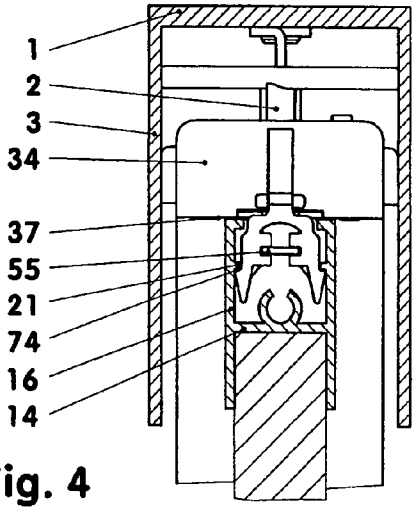
FIG. 4: a cross-section of FIG. 3.

FIGS. 1 and 2 show an upper guide structure of a sliding door 1. In FIGS. 3 and 4, the sliding door 10 is shown installed in an upper door guide track 1. The sliding door 10 comprises a door fitting 30 which is arranged on the door panel 11. The door fitting 30 has for example two guide rollers 31. By means of these guide rollers 31, the sliding door 10 is guided for example in a U-shaped door guide track 1 so as to be movable between a closed and an open end position. A slide shoe 32 on the top side 33 of the door fitting 30 limits pivoting of the sliding door 10 for example during sudden braking. In the exemplary embodiment shown, the door fitting 30 comprises an acceleration and deceleration device 41. Together with a carrier 2, which is arranged for example in the door guide track 1, the sliding door 10 can be controllably slowed down before it reaches for example the closed end position so that the sliding door 10 reaches the closed end position without strike. The acceleration and deceleration device 41 may be effective on the sliding door 10 alone or it may cooperate with another acceleration and deceleration device which is arranged for example in a bottom door fitting.

A door fitting 30 for guiding the sliding door 10 at the top may be arranged at the—in closing direction—front end of the sliding door 10. The longitudinal direction 15 of the sliding door 10 corresponds to the guide direction 5 which is determined by the door guide track 1 and the door fitting 30 or door fittings 30.

In the shown exemplary embodiment the sliding door panel 11 has a support frame 12 which comprises for example a horizontal profile element 13 and a vertical profile element 23. The horizontal profile element 13 has an at least essentially H-shaped cross-section with a horizontal profile web 14. The two side webs 16 are arranged parallel to each other and delimit a profile opening 17. At their upper ends, the side webs 16 are provided with overlap ledges 18 which project toward each other. In addition, the side webs 16 are provided at their inner longitudinal sides with longitudinal webs 21. In the profile opening 17, a longitudinally extending threaded sleeve 19 is formed on the profile web 14, which may extend over the full length of the horizontal profile element 13 or only along a section of the horizontal profile element 13. The threaded sleeve 19 into which a mounting screw can be threaded may be longitudinally slotted.

At its side facing away from the profile opening 24 the vertical profile element 23 is in the form of a hollow profile with an essentially rectangular cross-section. In this profile element 23, the mounting screw 22 is arranged by which the vertical profile element 23 is connected to the horizontal profile element 13.

The support frame 12 extends around, and supports, a door panel 25, which may consist for example of metal, wood, glass, plastic, a composite material, etc.

Figure 6:
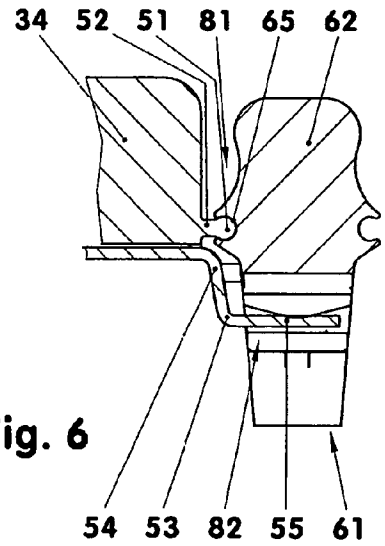
FIG. 6: a detail of the coupling between the base body and the support element.
Figure 5:
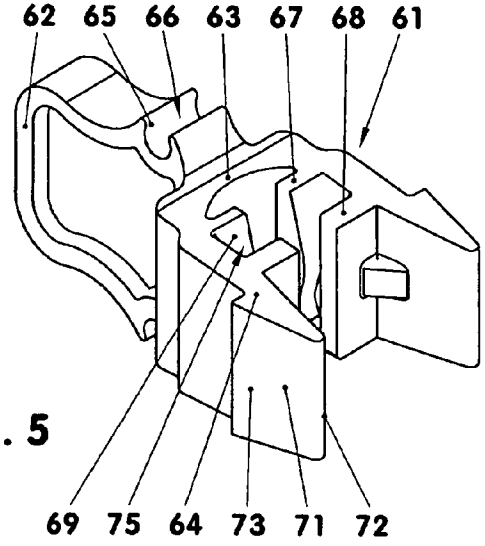
FIG. 5: a support element.

The door fitting 30 comprises a base body 34 and a support element 61 releasably connected to the base body 34, see FIG. 6. The base body 34 has an approximately square contour. It has a flat bottom 37 with which it is disposed in the exemplary embodiment on the horizontal profile element 13.

The area of the base body 34 facing toward the front side 26 of the sliding door 10 has an insert opening 36. The length of this insert opening 36 is in the exemplary embodiment 50% of the length of the base body 34. In this insert opening 36, a carrier element 42 of the acceleration and deceleration device 41 is arranged. The carrier element 42 is movable between a force- and/or form-locking park position and an end position. During closing of the sliding door 10, for example, the carrier element 42 which is in the park position comes into contact with the carrier 2 before the sliding door reaches the closed end position and is engaged therewith. Upon further closing of the sliding door 10, the carrier element 42 is released from its park position. Then, the carrier element 42 is pulled by an energy store, which is being discharged, toward the end position and is slowed down by a cylinder piston unit. The resultant of the two superimposed forces moves the sliding door 10 into the closed end position.

In the base body 34, furthermore, the guide rollers 31 are supported. In the exemplary embodiment, these guide rollers 31 have parallel axes. The axes extend normal to the longitudinal direction 15 and parallel, and symmetrically to, the longitudinal center plane of the base body 34. The guide rollers 31 may also have a crowned running surface. In the exemplary embodiment, both axes are supported in the base body 34 at both sides. The two guide rollers 31 are arranged with respect to the front side 26 at the two front corners of the base body 34. They project to the side and also to the front from the base body 34.

At the bottom 37 of the base body 34 below the guide rollers 31, there is a support plate 38, which extends in a plane normal to the longitudinal direction 15 and via which the base body 34 can be attached to the support frame 12.

At the backside of the base body facing away from the transverse guide rollers 31, a transversely extending pivot rod 51 is arranged. The pivot rod 51 extends parallel to the bottom 37 in a plane which is normal to the longitudinal direction 15. The pivot rod 51 is for example formed integrally with a housing 39 of the base body 34. In the exemplary embodiment, the pivot rod 51 is for example arranged symmetrically with respect to the longitudinal center axis of the door fitting 30 and has a diameter of 2 mm and a length of 7 mm. The thickness of the connecting web 52 to the housing in this exemplary embodiment is 70% of the diameter of the pivot rod; its length is 60% of the diameter mentioned.

Furthermore, at the backside of the base body 34 an angled piece 53 is arranged. In the exemplary embodiment, this piece projects downwardly from the bottom 37 where it forms a stop web, and then extends in the longitudinal direction 15 beyond the pivot rod 51. The distance of the guide surface 55 from the pivot axis of the pivot rod 51 is for example three and a half times the diameter of the pivot rod 51. In the exemplary embodiment, the pivot axis is the geometric center line of the pivot rod 51.

The stop web 54 extends with respect to the plane of the bottom 37 for example at an angle of 80°. With respect to a vertical plane on the bottom 37, the stop web 54 is inclined in the direction of the pivot axis. The length of the guide surface 55 which extends parallel to the bottom 37 is for example five times the diameter of the pivot rod.

The support element 61 is in the exemplary embodiment symmetrical with respect to its longitudinal center plane and also symmetrical with respect to its transverse center plane. It has a central vertical web 62 which is oriented in the longitudinal direction 15 and which stands on a transverse web 63. On the side facing away from the vertical web 62, two clamping webs 64 project from the transverse web 63. The two clamping webs 64 are arranged in spaced relationship and symmetrical with respect to each other symmetrical with respect to the longitudinal center plane of the support element 61. The height of the two clamping legs normal to the plane of the transverse web 63 corresponds for example to the height of the vertical web 62.

The vertical web 62 is provided on each of its two front sides, which are oriented in the longitudinal direction, with a pivot prong 65. In the exemplary embodiment, the individual pivot prong 65 is provided with an insert opening 66 extending in the longitudinal direction. The engagement angle of the pivot prong 65 is for example 280 degrees. The accommodation cavity diameter of the pivot prong 65 is for example five hundredth millimeter greater than the diameter of the pivot rod. The pivot prong 65 is in the transverse direction half as long as the pivot rod 51.

Both clamping legs 64 have upper clamping webs 67 and lower clamping webs 68 which face each other. The clamping webs 67, extend parallel to one another. Their distance is for example 30% greater than the thickness of the guide surface area 55. In the exemplary embodiment, the upper clamping webs 67 are provided with introduction ramps 69.

At the side of the clamping legs 64 facing away from the longitudinal center plane, the clamping legs 64 are provided clamping wedges 71. The clamping wedges 71 have each a wedge tip line 72. In the assembled position, see FIGS. 1-4 and 6, the wedge tip lines 72 form in each case the lower end of the clamping legs 64. The wedge angle is for example 23 degrees. Herein, the outer wedge surface 73 extends from the bottom to the top for example at an angle of 12 degrees with respect to the vertical longitudinal center plane of the door fitting 30. The upper wedge surfaces 74 which extend in each case parallel to the transverse web 63 is disposed below the lower clamping web 68 and is oriented for example parallel to the transverse web 63.

During assembly, for example first, the support element 61 is placed onto the guide surface 55, so that the guide surface 55 is disposed between the clamping webs 67, 68. During insertion of the support element 61 in the longitudinal direction 15, the pivot prong 65 receives and engages the pivot rod 51. The installation direction 83 of the pivot rod engagement connection 51, 65 is in this exemplary embodiment oriented in the longitudinal direction 15. The pivot prong 65 and the pivot rod 51 form a first joint area in 81. This first joint area 81 has a certain pivoting degree limit. Its pivot shaft is formed by the pivot rod 51. The engagement connection 51, may have for example a pivot shaft 51 which extends vertically. Also other forms of such engagement connections are feasible.

The guide area 55 and the support element surrounding it form a second joint area 82 which is spaced from the first joint area 81. As a slide joint 55, 61, the second joint area 82 has a degree of axial freedom. This axial degree of freedom of the slide joint 55, 61 is tangential to an imaginary coaxial cylinder around the pivot axis of the first joint area 81. In the exemplary embodiment, the guide area 55 is oriented in the longitudinal direction 15. The engagement structure 75 has an introduction ramp 69 so that the flat guide area 55 can be easily inserted into the support element 61.

It is also possible to arrange the assembly direction 83 of the engagement connection 51, 65 and the parallel axial degree of freedom of the slide joint 55, 61 with an orientation other than the longitudinal direction 15. The installation direction 83 may be for example at an angle to the longitudinal direction 15 of up to 90°.

The support element 61 may abut the stop web 54 after its engagement. It is securely connected to the base body 34.

The preassembled door fitting 30 is for example placed onto the horizontal profile element 13 of the sliding door 10. Herein, the door fitting 30 is so oriented that its longitudinal direction 15 coincides with the guide direction 5 of the sliding door 10. The support plate 38 is inserted into the vertical profile element 23. The support element 61 is pushed down for example by pressing on the vertical web 62 which forms a handle. Hereby, the clamping legs 64, which project in a plane normal to the guide direction 5, are elastically deformed. The outer wedge surfaces 73 slide downwardly along the overlap ledges 18 and along the longitudinal webs 21 until the upper wedge surfaces 74 move over and behind the longitudinal webs 21. The clamping legs 64 move back partially out of their elastically deformed position. Now, the door fitting 30 can be moved in the longitudinal direction 15 until the support plate 38 abuts the vertical profile element 23. Finally, the support plate 38 can be fixed to the vertical profile element by means of a mounting screw 22. However, also another assembly order is possible.

Now, the whole sliding door 10 can be placed into for example a U-shaped guide track 1. Hereby, the two longitudinal webs 3 of the door guide track 1 may abut the transverse guide rollers 31. In the door guide track 1, furthermore, the carrier 2 is arranged. If necessary the position of the sliding door 10 can be adjusted in vertical direction by means of a lower height-adjustable door fitting.

The sliding door 10 can be opened and closed as described earlier.

In order to exchange the door fitting 30, the mounting screw 22 can be removed. The base body 34 can then be raised relative to the sliding door 10. While pulling the base body 34 and holding the support or handle element 61 the snap-in connection can be released. After the separation of the push element 55, 61, for example, a new base body 34 can be inserted. After engagement with the support element 61 and the fixing of the support plate 38, the sliding door 10 can again be placed into the door guide track 1.

The door fitting 30 disclosed herein can be used in connection with differently shaped horizontal profile elements. For example, by an exchange of the support element 61, the door fitting 30 can be adapted to profile elements of different width. The support element 61 can be fixed in the profile element 13 by force-locking to the side webs 16. With such an embodiment neither the longitudinal webs 21 nor the overlap ledges 18 are required.

Also combinations of the various exemplary embodiments are feasible.

REFERENCE NUMBERS LIST

| | |
|---|---|
| 1 | Door guide track |
| 2 | Carrier |
| 3 | Longitudinal web |
| 5 | Guide direction |
| 10 | Sliding door |
| 11 | Door panel |
| 12 | Support frame |
| 13 | Horizontal profile element |
| 14 | Profile web |
| 15 | Longitudinal direction |
| 16 | Side webs |
| 17 | Profile opening |
| 18 | Overlap ledges |
| 19 | Threaded sleeve |
| 21 | Longitudinal web |
| 22 | Mounting screw |
| 23 | Vertical profile element |
| 24 | Profile opening |
| 25 | Door panel |
| 26 | Front side |
| 30 | Door fitting |
| 31 | Guide roller |
| 32 | Slide shoe |
| 33 | Topside |
| 34 | Base body |
| 36 | Insert opening |
| 37 | Bottom |
| 38 | Support plate |
| 39 | Housing |
| 41 | Acceleration an deceleration device |
| 42 | Carrier element |
| 51 | Pivot rod, part of the snap-in connection |
| 52 | Connecting web |
| 53 | Angled piece |
| 54 | Stop web |
| 55 | Guide area, part of a push joint |

-continued

| | |
|---|---|
| 61 | Support element, part of the push joint |
| 62 | Vertical web |
| 63 | Transverse web |
| 64 | Clamping leg |
| 65 | Pivot prong |
| 66 | Insert opening |
| 67 | Upper clamping webs |
| 68 | Lower clamping webs |
| 69 | Introduction ramps |
| 71 | Clamping wedge |
| 72 | Wedge tip line |
| 73 | Outer wedge surface |
| 74 | Upper wedge surface |
| 75 | Engagement structure |
| 81 | First joint area |
| 82 | Second joint area |
| 83 | Installation direction |

What is claimed is:

1. A door fitting (30) for an upper guidance of a sliding door (10) which comprises a base body (34) and at least one support element (61) which is releasably arranged on the base body (34), wherein the base body (34) and the support element (61) are interconnected by first and second spaced joint areas (81, 82), the first joint area (81) comprises a snap-in connection (51, 65) with a predetermined pivot capability, and the second joint area (82) comprises a slide joint (55, 61) with an axial degree of freedom, which is oriented tangentially with respect to a coaxial cylinder extending around the pivot axis of the first joint area (81) and parallel to an installation direction (83) of the snap-in connection (51, 65).

2. The door fitting (30) according to claim 1, wherein the first joint area (81) comprises a pivot rod (51) and a pivot prong (65).

3. The door fitting (30) according to claim 1, wherein the second joint area (82) comprises a flat guide area (55) with an engagement structure (75).

4. The door fitting (30) according to claim 1, wherein the engagement structure (75) comprises introduction ramps (69).

5. The door fitting (30) according to claim 1, wherein the base body (34) comprises a support plate (38).

6. The door fitting (30) according to claim 1, wherein the support element (61) comprises two clamping legs (64) which project in a plane normal to a guide direction (5) of the door guide track (1).

7. The door fitting (30) according to claim 1, the base body (34) carries two transverse guide rollers (31).

8. The door fitting (30) according to claim 1., wherein the base body (34) includes an acceleration and deceleration device (41).

9. A sliding door (10) including the door fitting (30) according to claim 1.

* * * * *